US009096082B2

(12) United States Patent
Momose et al.

(10) Patent No.: US 9,096,082 B2
(45) Date of Patent: Aug. 4, 2015

(54) RECORDING APPARATUS

(71) Applicant: SEIKO EPSON CORPORATION, Tokyo (JP)

(72) Inventors: Seigo Momose, Nagano (JP); Toshimitsu Hirai, Yamanashi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/189,496

(22) Filed: Feb. 25, 2014

(65) Prior Publication Data

US 2014/0247314 A1 Sep. 4, 2014

(30) Foreign Application Priority Data

Mar. 4, 2013 (JP) ..... 2013-041590

(51) Int. Cl.

| | |
|---|---|
| ***B41J 2/01*** | (2006.01) |
| ***B41J 11/00*** | (2006.01) |
| *B41J 13/00* | (2006.01) |
| *B65H 1/00* | (2006.01) |
| *B65H 1/22* | (2006.01) |
| *B65H 5/02* | (2006.01) |
| *B65H 5/04* | (2006.01) |
| *B41J 15/04* | (2006.01) |

(52) U.S. Cl.

CPC ..... *B41J 11/007* (2013.01); *B41J 15/04* (2013.01)

(58) Field of Classification Search

CPC .... B41J 11/005; B41J 11/0055; B41J 11/007; B41J 13/10; B41J 13/103; B41J 13/14; B41J 13/16; B65H 5/026

USPC ..... 347/104; 271/162, 164, 275; 400/642, 400/645.4, 645.5

See application file for complete search history.

(56) References Cited

U.S. PATENT DOCUMENTS

| | | | | | |
|---|---|---|---|---|---|
| 3,589,286 | A | * | 6/1971 | Acks | 101/228 |
| 3,774,271 | A | * | 11/1973 | Depuy et al. | 26/75 |
| 4,217,682 | A | * | 8/1980 | Young et al. | 26/98 |
| 5,147,274 | A | * | 9/1992 | Mandel | 493/409 |
| 5,265,856 | A | * | 11/1993 | Walker | 271/3.05 |
| 5,687,833 | A | * | 11/1997 | Dalessio et al. | 198/786 |
| 8,292,420 | B2 | * | 10/2012 | Weingartner et al. | 347/104 |
| 8,408,539 | B2 | * | 4/2013 | Moore | 271/193 |

(Continued)

FOREIGN PATENT DOCUMENTS

| | | | |
|---|---|---|---|
| JP | 06-128875 | A | 5/1994 |
| JP | 2000-282374 | A | 10/2000 |

(Continued)

OTHER PUBLICATIONS

The extended European Search Report for European Application No. 14157715.5 mailed Jun. 4, 2014.

*Primary Examiner* — Jannelle M Lebron
*Assistant Examiner* — Jeremy Bishop
(74) *Attorney, Agent, or Firm* — Global IP Counselors, LLP

(57) ABSTRACT

There is provided an adhesive belt configured to support and transport a recording medium, a recording head configured to record by discharging ink onto the recording medium which is supported on the adhesive belt, and a guiding section arranged at an upstream side relative to the recording head in a transport direction of the recording medium and configured to guide fluff on an end section, in an intersecting direction that intersects with the transport direction, of the recording medium in a direction to an outside of the recording medium in the intersecting direction.

10 Claims, 7 Drawing Sheets

(56) References Cited

U.S. PATENT DOCUMENTS

| | | | | |
|---|---|---|---|---|
| 8,408,829 | B2 * | 4/2013 | Kawaguchi et al. | 400/352 |
| 2008/0107461 | A1 * | 5/2008 | Miyata et al. | 399/343 |
| 2009/0295895 | A1 | 12/2009 | Weingartner et al. | |
| 2012/0319347 | A1 | 12/2012 | Moore | |
| 2013/0136521 | A1 * | 5/2013 | Garcia et al. | 400/642 |

FOREIGN PATENT DOCUMENTS

| | | | |
|---|---|---|---|
| JP | 2010-255133 | A | 11/2010 |
| JP | 2010-264596 | A | 11/2010 |
| WO | 2006/125239 | A1 | 11/2006 |

* cited by examiner

RECORDING APPARATUS

CROSS-REFERENCE TO RELATED APPLICATIONS

This application claims priority to Japanese Patent Application No. 2013-041590 filed on Mar. 4, 2013. The entire disclosure of Japanese Patent Application No. 2013-041590 is hereby incorporated herein by reference.

BACKGROUND

1. Technical Field

The present invention relates to a recording apparatus which is provided with a transport mechanism which transports a recording medium using an adhesive belt.

2. Related Art

In the prior art, recording apparatuses, which are provided with a transport mechanism which transports a recording medium by placing the recording medium on a moving belt, are used. Among such recording apparatuses, there are disclosed recording apparatuses which are provided with an adhesive belt, as the moving belt, where an adhesive, which holds the recording medium by bonding such that the recording medium is able to be peeled off, is attached to a surface where the recording medium is placed. For example, Japanese Laid-Open Patent Application Publication No. 2010-255133 discloses a recording apparatus which is provided with an endless belt which transports the recording medium by adhering and fixing the recording medium. In addition, as another example of the recording apparatus which transports the recording medium using an adhesive belt in this manner, Japanese Laid-Open Patent Application Publication No. 2010-264596 discloses a recording apparatus which is provided with a pressing member which holds down floating of the recording medium.

There are various types of target recording media and there are cases when target recording media which have a fibrous material have end sections which have fluff. In a case where recording is performed on a recording medium where the end sections have fluff, as well as ink discharge failures occurring due to fluff interfering with a recording head, there are cases where fluff reduces image quality by fluff becoming attached to ink which is discharged from the recording head at an image forming portion of the recording medium.

However, the recording apparatus which is disclosed in Japanese Laid-Open Patent Application Publication No. 2010-255133 does not have a configuration which suppresses such effects of fluff on the end sections of the recording medium. In addition, there is a possibility with the recording apparatus which is disclosed in Japanese Laid-Open Patent Application Publication No. 2010-264596 that fluff will reach the image forming portion of the recording medium even though it is possible to suppress fluff interfering with the recording head and the recording apparatus which is disclosed in Japanese Laid-Open Patent Application Publication No. 2010-264596 does not have a configuration which suppresses a reduction in image quality in a case where fluff reaches the image forming portion of the recording medium.

In this manner, the recording apparatuses in the prior art do not sufficiently suppress the effects of fluff on the end sections of the recording medium when recording on the recording medium.

SUMMARY

Therefore, an object of the present invention is to suppress the effects of fluff on an end section of a recording medium when recording on the recording medium.

In order to solve the problems described above, a recording apparatus of a first aspect of the invention includes an adhesive belt configured to support and transport a recording medium, a recording head configured to record by discharging ink onto the recording medium which is supported by the adhesive belt, and a guiding section arranged at an upstream side relative to the recording head in a transport direction of the recording medium and configured to guide fluff on an end section, in an intersecting direction that intersects with the transport direction, of the recording medium in a direction to an outside of the recording medium in the intersecting direction.

Here, the "adhesive belt" has the meaning of a belt where an adhesive, which holds the recording medium by bonding such that the recording medium is able to be peeled off, is attached to a surface where the recording medium is supported. In addition, "an upstream side relative to the recording head in a transport direction of the recording medium" has the meaning of more to the upstream side than a region where recording is possible, which corresponds to a region of the recording head where ink is discharged (for example, a nozzle array which is formed of a plurality of nozzles which discharge ink), in the transport direction of the recording medium.

In addition, that the guiding section "arranged at an upstream side relative to the recording head in a transport direction of the recording medium" has the meaning that a portion, which guides fluff in the direction to the outside, of the guiding section is provided more to the upstream side than a region where recording is possible in the recording head in the transport direction. That is, there may be a configuration where a portion of the guiding section other than the portion, which guides fluff in the direction to the outside, is provided other than at locations more to the upstream side than the region where recording is possible in the recording head in the transport direction.

According to the present aspect, there is the guiding section which is configured to guide fluff on the end section of the recording medium in the direction to the outside. As a result, even when fluff reaches an image forming portion of the recording medium, it is possible to move fluff from the image forming portion by guiding fluff in the direction to the outside when recording on the recording medium. That is, it is possible to suppress the effects of fluff on the end section of the recording medium when recording on the recording medium.

A recording apparatus of a second aspect of the invention is the recording apparatus of the first aspect, which further includes a fluff attachment section configured to attach the fluff to the adhesive belt.

According to the present aspect, the fluff attachment section which attaches fluff to the adhesive belt is provided. As a result, in a case where fluff reaches the image forming portion of the recording medium, it is possible to move fluff from the image forming portion by guiding fluff in the direction to the outside and to suppress fluff which is moved from reaching the image forming portion of the recording medium again.

Here, the fluff attachment section may be integral with the guiding section or may be a separate body.

A recording apparatus of a third aspect of the invention is the recording apparatus according to the first or second aspect, where the guiding section is configured to come into contact with the end section at a position which opposes the adhesive belt, and a shape of a contact section of the guiding section with the end section on the upstream side in the transport direction is inclined toward a downstream side in the transport direction from an inside of the adhesive belt toward an outside.

According to this aspect, the shape of the contact section of the guiding section with the end section on the upstream side in the transport direction is inclined toward the downstream side in the transport direction from the inside of the adhesive belt toward the outside. As a result, it is possible to move fluff from the image forming portion by guiding fluff in the direction to the outside with a simple configuration. The shape of the contact section of the guiding section with the end section may be inclined by being curved.

A recording apparatus of a fourth aspect of the invention is the recording apparatus according to the first or second aspect, where the guiding section is a rotating body which is configured to come into contact with the end section at a position which opposes the adhesive belt such that a contact section of the rotating body with the end section moves from an inside of the adhesive belt toward an outside with the transport direction as an axis direction of an axis of rotation.

According to the present aspect, the guiding section is a rotating body which is configured such that the contact section of the rotating body with the end section moves from the inside of the adhesive belt toward the outside with the transport direction as the axis direction of the axis of rotation. As a result, it is possible to move fluff from the image forming portion by guiding fluff in the direction to the outside with high precision. Here, it is possible to preferably use a rotating brush as the rotating body.

A recording apparatus of a fifth aspect of the invention is the recording apparatus according to the fourth aspect, where the rotating body has a spiral shape where a screw thread is configured to be come into contact with the end section.

According to the present aspect, the rotating body has a spiral shape where a screw thread is configured to come into contact with the end section. As a result, it is possible to move fluff from the image forming portion by guiding fluff in the direction to the outside with a simple configuration.

A recording apparatus of a sixth aspect of the invention is the recording apparatus according to the second aspect, where the fluff attachment section is a rib which is configured to come into contact with the end section at a position which opposes the adhesive belt, and the shape of the rib is inclined toward the downstream side in the transport direction from an inside of the adhesive belt toward an outside.

According to the present aspect, the shape of the rib is inclined to the downstream side in the transport direction from the inside of the adhesive belt toward the outside. As a result, in a case where fluff reaches the image forming portion of the recording medium, it is possible for fluff to be attached to the adhesive belt while guiding fluff in the direction to the outside with a simple configuration. Here, the shape of the rib may be inclined by being curved.

A recording apparatus of a seventh aspect of the invention is the recording apparatus according to any one of the first to sixth aspects, where a constituent member of the guiding section is all arranged at the upstream side relative to the recording head in the transport direction.

According to the present aspect, the constituent member of the guiding section is all arranged at the upstream side relative to the recording head in the transport direction. As a result, it is possible to suppress the effects of fluff on the end section of the recording medium and it is possible to record up to the end section of the recording medium in a direction which intersects with the transport direction.

A recording apparatus of an eighth aspect of the invention is the recording apparatus according to any one of the first to seventh aspects, where the guiding section is movable in directions which approach and move away from the adhesive belt, and the recording head is movable in directions which approach and move away from the adhesive belt by being linked with the guiding section.

According to the present aspect, the recording head is movable in directions which approach and move away from the adhesive belt by being linked with the guiding section which come into contact with the recording medium. As a result, it is possible to preserve a constant distance (a paper gap) between the recording head and the recording medium which is supported by the adhesive belt even when using target recording media with various thicknesses.

A recording apparatus of a ninth aspect of the invention is the recording apparatus according to any one of the first to eighth aspects, where the guiding section is movable in the intersecting direction.

According to the present aspect, since the guiding section is movable in the intersecting direction, it is possible for the guiding section to correspond to target recording media with various widths (lengths in the intersecting direction).

A recording apparatus of a tenth aspect of the invention is the recording apparatus according to any one of the first to ninth aspects, where the recording head is configured to record on the recording medium by scanning back and forth by being mounted onto a carriage which is movable back and forth in the intersecting direction, a sensor is provided in the carriage, and the sensor is configured to detect an end section of a region where recording is possible using the recording head in the intersecting direction of the recording medium by detecting the guiding section.

According to the present aspect, the guiding section is also used as a detection section when detecting the region where recording is possible in the intersecting direction using the sensor. As a result, it is possible to detect the region where recording is possible in the intersecting direction without providing new separate constituent members.

BRIEF DESCRIPTION OF THE DRAWINGS

Referring now to the attached drawings which form a part of this original disclosure.

DETAILED DESCRIPTION OF EXEMPLARY EMBODIMENTS

First Embodiment

FIG. 1 to FIG. 4

Below, a recording apparatus according to an embodiment of the present invention will be described in detail with reference to the accompanying drawings.

Figure 1:
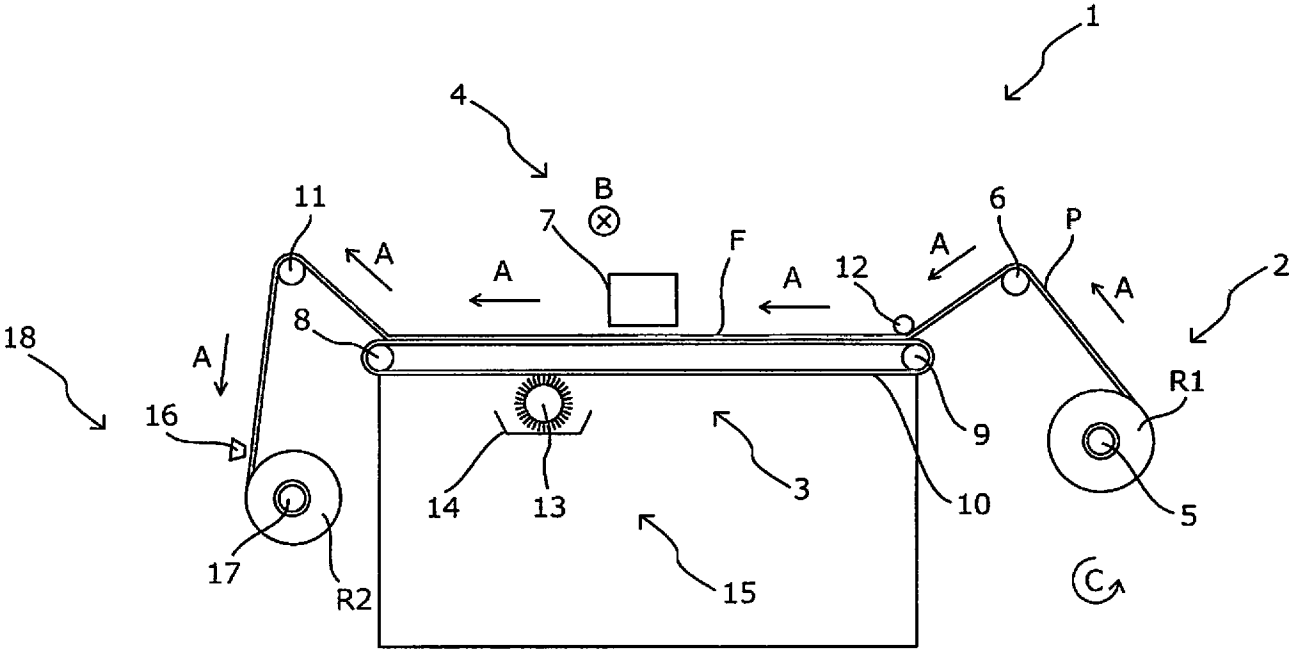
FIG. 1 is a schematic side surface diagram representing a recording apparatus of a first embodiment of the present invention.

FIG. 1 is a schematic side surface diagram of a recording apparatus 1 according to a first embodiment of the present invention.

The recording apparatus 1 of the present embodiment is provided with a feeding section 2 which is able to feed out a roll R1 of a recording medium P in order to perform recording. In addition, a transport mechanism 3 is provided which transports the recording medium P in a transport direction A using an adhesive belt 10 which supports the recording medium P on a support surface F where an adhesive is attached. In addition, a recording mechanism 4 is provided which records by a recording head 7 scanning back and forth in an intersecting direction B which intersects with the transport direction A of the recording medium P. In addition, a cleaning mechanism 15 of the adhesive belt 10 is provided. Furthermore, a winding mechanism 18 is provided which has a winding shaft 17 which winds the recording medium P and a cutter 16 which cuts the recording medium P which is wound.

The feeding section 2 has a configuration where a rotating shaft 5 is provided to also be used for setting positions of the roll R1 of the recording medium P in order to perform recording, and where it is possible to feed out the recording medium P from the roll R1 which is set on the rotating shaft 5 to the transport mechanism 3 via a driven roller 6. Here, when the recording medium P is fed out to the transport mechanism 3, the rotating shaft 5 rotates in a rotation direction C.

The transport mechanism 3 is provided with the adhesive belt 10 where the recording medium P which is fed out from the feeding section 2 is placed and transported, and a transport roller 8 and a driven roller 9 which move the adhesive belt 10. The recording medium P is placed by being pressed and attached to the support surface F of the adhesive belt 10 using a pressing roller 12. Here, when the recording medium P is transported, the transport roller 8 rotates in the rotation direction C.

The recording mechanism 4 has the recording head 7, a carriage 24 (refer to FIG. 2) where the recording head 7 is mounted, and a carriage motor which is not shown in the diagram which moves the carriage 24 back and forth in the intersecting direction B. Here, the intersecting direction B is a direction which is orthogonal with regard to the paper surface in FIG. 1.

During recording, the recording head 7 records by scanning back and forth, but the transport mechanism 3 stops transporting of the recording medium P during the recording and scanning (during movement of the recording head). In other words, back and forth scanning of the recording head 7 and transporting of the recording medium P are alternately performed during recording. That is, the transport mechanism 3 intermittently transports the recording medium P to correspond to back and forth scanning of the recording head 7 during recording.

The recording apparatus 1 of the present embodiment is provided with the recording mechanism 4 which records by the recording head 7 scanning back and forth, but the recording apparatus 1 is not limited to a recording mechanism with this configuration and the recording apparatus 1 may be provided with a recording mechanism which has a so-called line head which is provided with a nozzle row which discharges ink in a direction which intersects with the transport direction A.

The cleaning mechanism 15 of the adhesive belt 10 has a cleaning unit 13 which is configured by joining a plurality of cleaning rollers in a direction of the axis of rotation, and a tray 14 into which a cleaning agent for cleaning the cleaning unit 13 flows.

The winding mechanism 18 is a mechanism which winds the recording medium P which is transported from the transport mechanism 3 via the driven roller 11 as recording is carried out, and it is possible to wind the recording medium P as a roll R2 by setting a paper tube or the like for winding on the winding shaft 17 and wrapping the recording medium P around the paper tube or the like.

Next, guiding sections 19 will be described which guide fluff on end sections 25, in the direction B which intersects with the transport direction A, of the recording medium P which is provided on the support surface F of the adhesive belt 10 of the recording apparatus 1 of the present embodiment in a direction to the outside of the recording medium P in the intersecting direction B.

Figure 2:
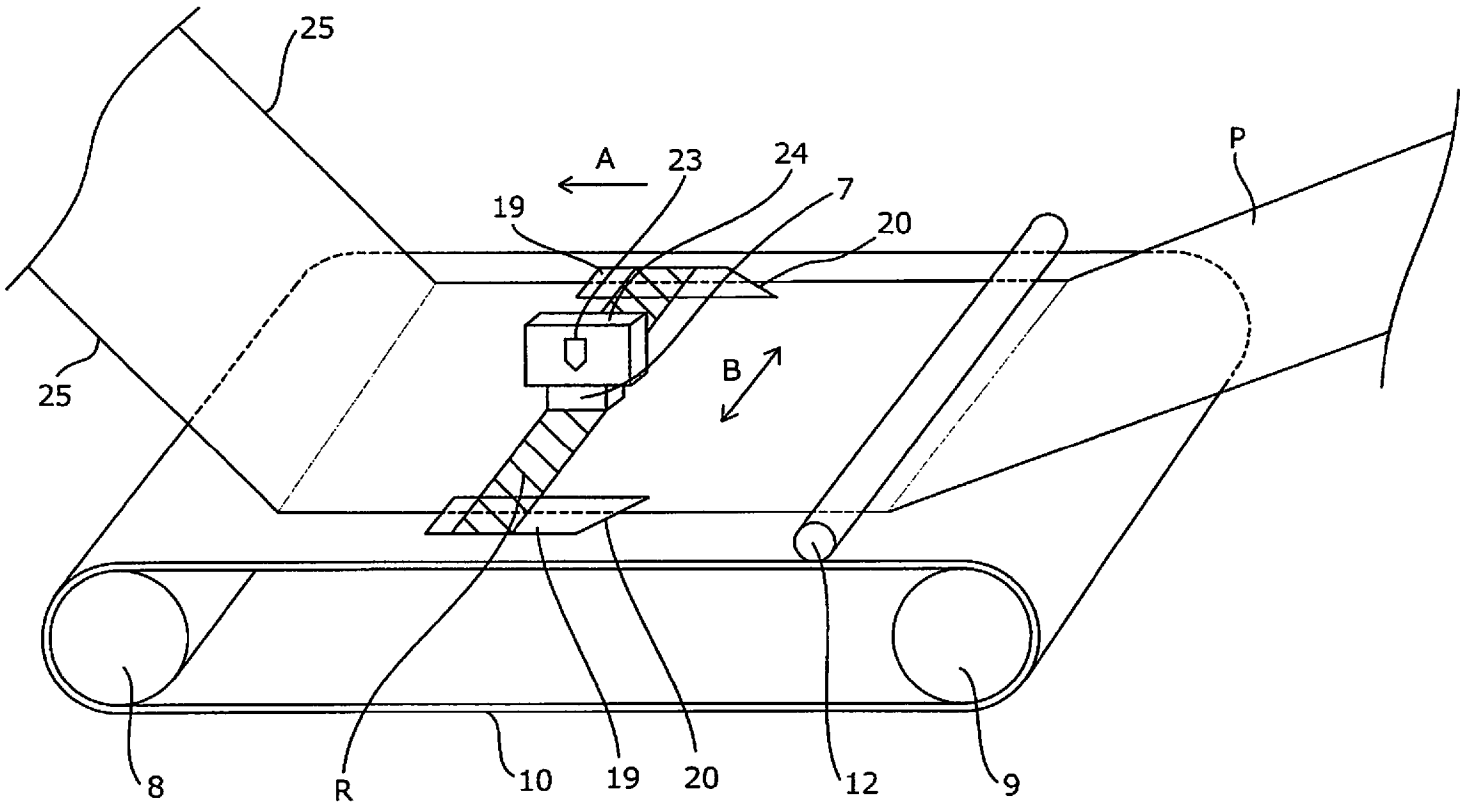
FIG. 2 is a schematic perspective diagram representing an adhesive belt of the recording apparatus of the first embodiment of the present invention.

FIG. 2 is a schematic perspective diagram representing the adhesive belt 10 of the recording apparatus 1 of the present embodiment.

The guiding sections 19, which are able to move in the intersecting direction B according to the width of the recording medium P, are provided at positions which oppose the support surface F of the adhesive belt 10 of the recording apparatus 1 of the present embodiment. It is possible for a user to move the guiding sections 19 to positions which come into contact with the end sections 25 of the recording medium P according to the width of the recording medium P. In this manner, the guiding sections 19 are provided to be able to come into contact with the end sections 25 at positions which oppose the adhesive belt 10. Then, contact sections of the guiding sections 19 with the end sections 25 on the upstream side of the guiding sections 19 in the transport direction A have inclined shapes 20 which are inclined to the downstream side in the transport direction A from the inside of the adhesive belt 10 to the outside.

In addition, the guiding sections 19 are provided such that the inclined shapes 20, which are portions in the guiding sections 19 which guide fluff 22 (refer to FIG. 3) on the end sections 25 of the recording medium P in the direction to the outside, are positioned more to the upstream side than a region R where recording is possible in the recording head 7 in the transport direction A. With these shapes, it is possible for the guiding sections 19 to guide the fluff 22 on the end sections 25 of the recording medium P in the direction to the outside prior to the recording medium P being transported to the region R where recording is possible.

On the other hand, the guiding sections 19 are provided such that portions of the guiding sections 19 overlap with the region R where recording is possible. In addition, an optical sensor 23 is provided in the carriage 24 where the recording head 7 is mounted. Since the recording apparatus 1 of the present embodiment has this configuration, it is possible for the optical sensor 23 to detect end sections of the region R where recording is possible in the intersecting direction B of the recording medium P using the recording head 7 by detecting the guiding sections 19 by the guiding sections 19 being moved along with the carriage 24 in the intersecting direction B.

In addition, in the recording apparatus 1 of the present embodiment, the recording head 7 is configured to be able to move in directions which approach and move away from the adhesive belt 10 by being linked with the guiding sections 19 using a moving mechanism which is not shown in the diagram. As a result, it is possible to preserve a constant distance (a paper gap) between the recording head 7 and the recording medium P which is supported by the adhesive belt 10 even when using the target recording media P with various thicknesses.

Next, ribs 21, as fluff attachment sections which are provided in the guiding sections 19 and which attach fluff on the recording medium P to the adhesive belt 10, will be described.

Figure 3:
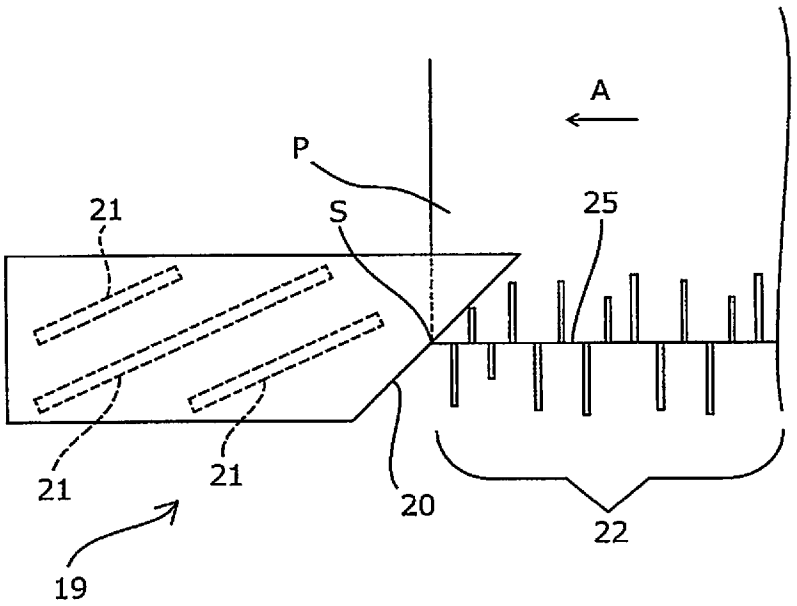
FIG. 3 is a schematic planar diagram of guiding sections of the recording apparatus of the first embodiment of the present invention.
Figure 4:
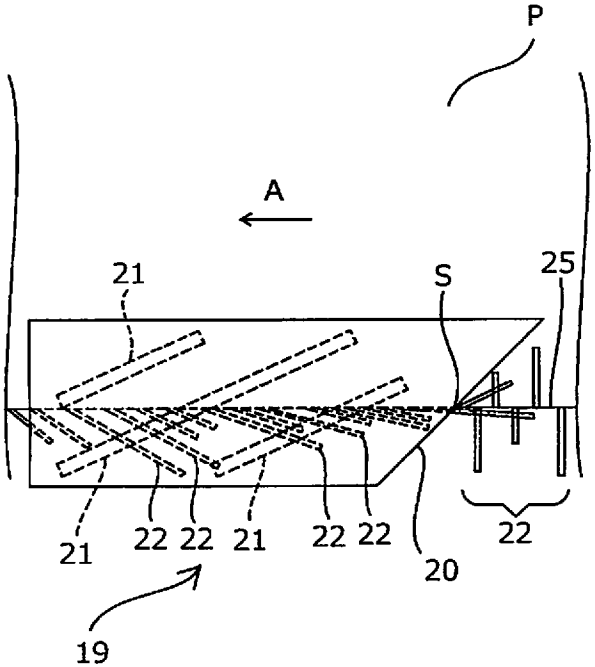
FIG. 4 is a schematic planar diagram of guiding sections of the recording apparatus of the first embodiment of the present invention.

FIG. 3 and FIG. 4 are schematic planar diagrams of the guiding sections 19 of the recording apparatus 1 of the present embodiment. FIG. 3 is a diagram representing a state where the guiding sections 19 and the recording medium P start to come into contact. FIG. 4 is a diagram representing a state where the recording medium P is transported from the state in FIG. 3 in the transport direction A, the ribs 21 which are provided in the guiding sections 19 come into contact with the recording medium P, and the ribs 21 attach the fluff 22 on the recording medium P to the adhesive belt 10.

As shown in FIG. 3 and FIG. 4, the fluff 22 is guided in the direction to the outside of the recording medium P along with transporting of the recording medium P based on contact start positions S of the inclined shapes 20 with the end sections 25 of the recording medium P. Then, the fluff 22, which is guided in the direction to the outside of the recording medium P, is attached to the adhesive belt 10 while being further guided in the direction to the outside due to the contact with the ribs 21 which are provided in the guiding sections 19. Here, in the recording apparatus 1 of the present embodiment, the ribs 21 which are the fluff attachment sections are configured to be inclined to the downstream side in the transport direction A from the inside of the adhesive belt 10 to the outside, but the fluff attachment sections are not limited to this configuration.

Second Embodiment

FIG. 5

Next, a recording apparatus according to a second embodiment of the present invention will be described.

Figure 5:
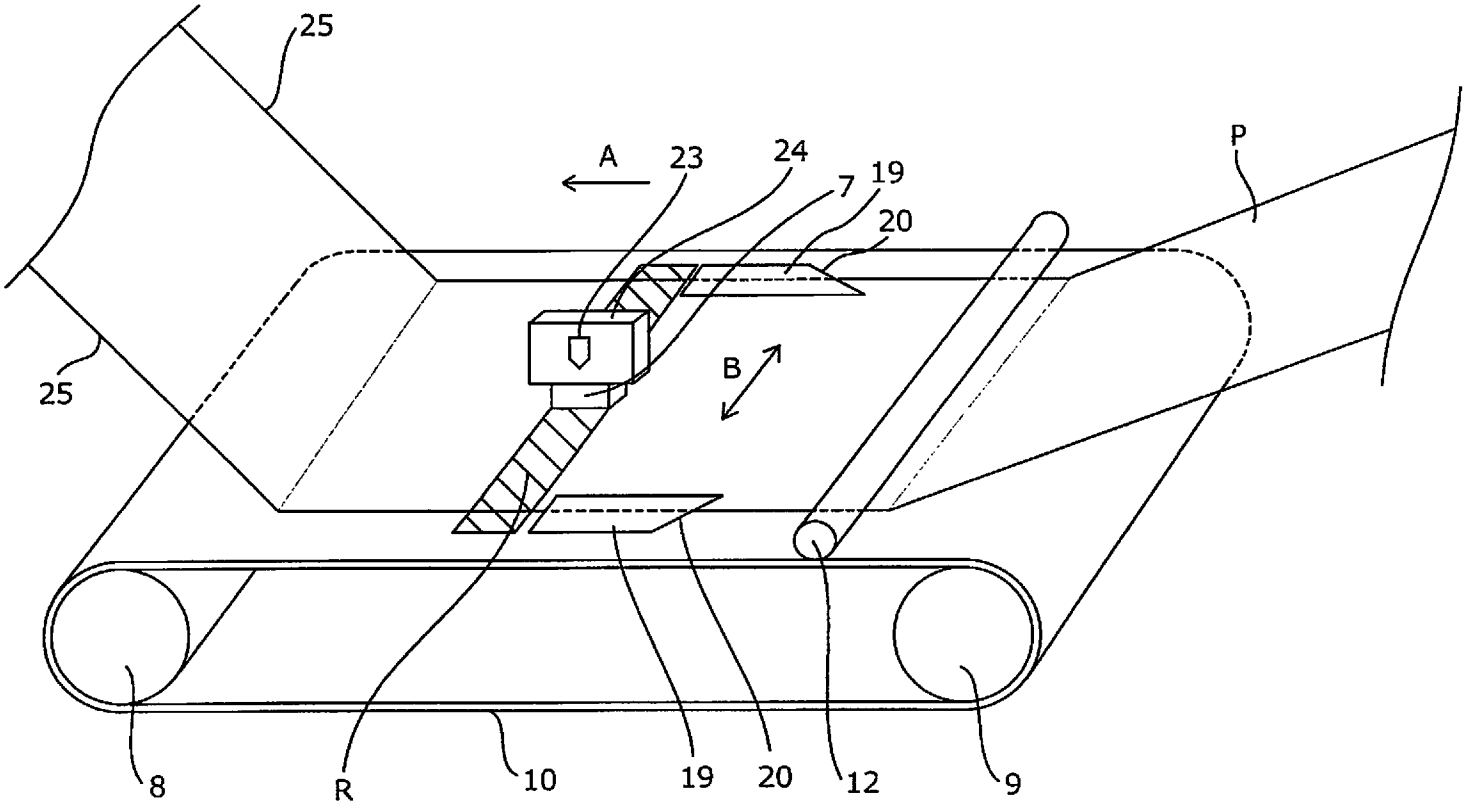
FIG. 5 is a perspective diagram representing an adhesive belt of a recording apparatus of a second embodiment of the present invention.

FIG. 5 is a schematic perspective diagram of the recording apparatus 1 according to the second embodiment of the present invention. Here, the constituent members which are common to the second embodiment and the embodiment described above are illustrated with the same reference numerals and detailed description of these constituent members will be omitted.

Only the positions of the guiding sections 19 in the recording apparatus 1 of the present embodiment are different to the recording apparatus 1 of the first embodiment.

In the recording apparatus 1 of the present embodiment, the guiding sections 19 are provided even further to the upstream side in the transport direction A than the recording apparatus 1 of the first embodiment. That is, all of the constituent members, which include not only the inclined shapes 20 of the guiding sections 19 but also the ribs 21, are provided so as to be positioned more to the upstream side than the region R where recording is possible in the recording head 7 in the transport direction A. With this configuration, it is possible for the recording apparatus 1 of the present embodiment to suppress the effects of the fluff 22 on the end sections 25 of the recording medium P and to record up to the end sections 25 of the recording medium P in the intersecting direction B which intersects with the transport direction A.

Third Embodiment

FIG. 6

Next, a recording apparatus according to a third embodiment of the present invention will be described.

Figure 6:
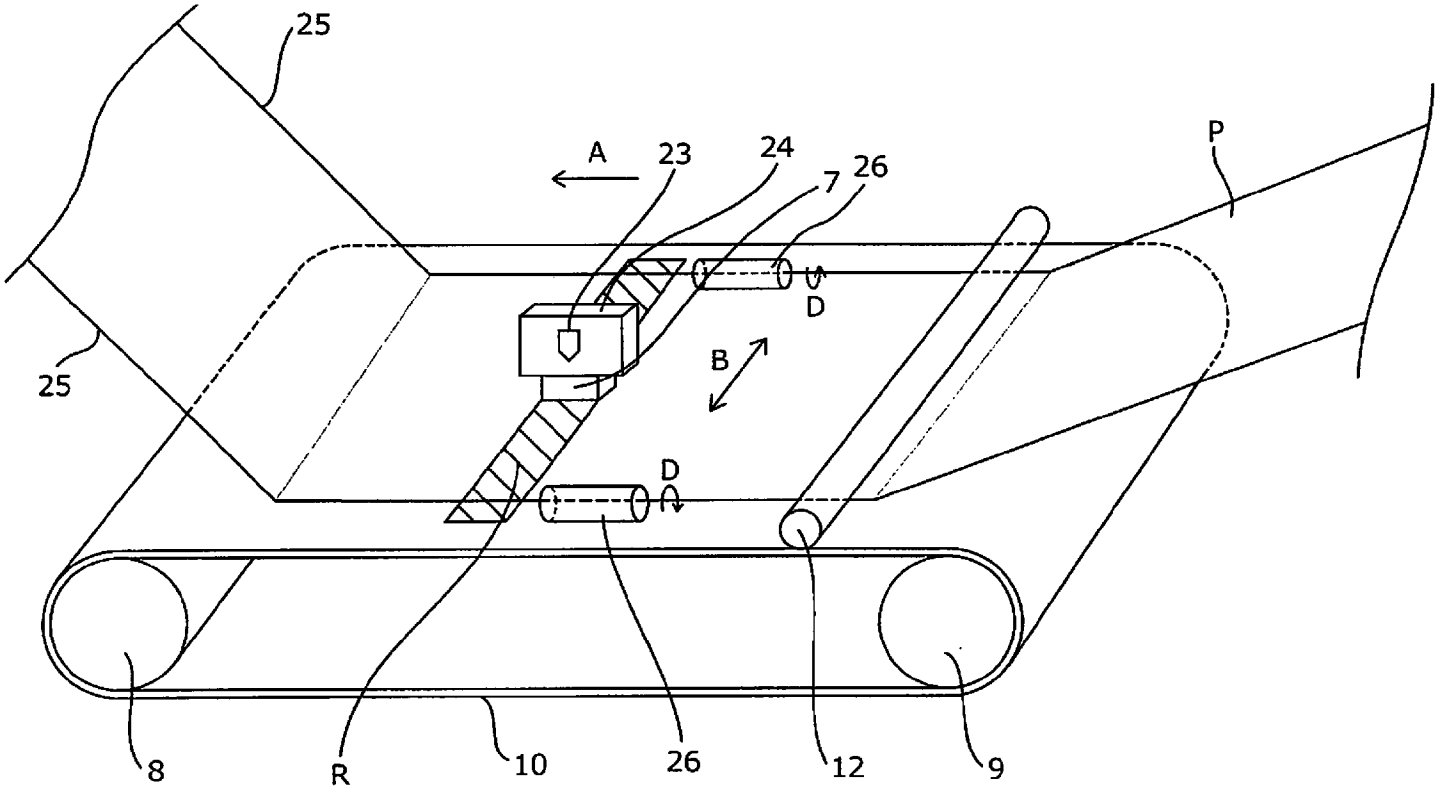
FIG. 6 is a schematic perspective diagram representing an adhesive belt of a recording apparatus of a third embodiment of the present invention.

FIG. 6 is a schematic perspective view of the recording apparatus 1 according to the third embodiment of the present invention. Here, the constituent members which are common to the third embodiment and the embodiments described above are illustrated with the same reference numerals, and detailed description of these constituent members will be omitted.

Only rotating brushes 26 which are rotating bodies being provided as guiding sections in the recording apparatus 1 of the present embodiment is different to the recording apparatus 1 of the second embodiment.

The recording apparatus 1 of the present embodiment is provided with the rotating brushes 26 which fulfill a role as the fluff attachment sections instead of the guiding sections 19 in the recording apparatus 1 of the second embodiment. The rotating brushes 26 rotate in a rotation direction D such that the contact sections of the rotating brushes 26 with the end sections 25 move from the inside of the adhesive belt 10 to the outside with the transport direction A as the axis of rotation. Due to rotation of the rotating brushes 26, the fluff 22 is guided in the direction to the outside of the recording medium P and the fluff 22 which is guided is attached to the adhesive belt 10.

Fourth Embodiment

FIG. 7

Next, a recording apparatus according to a fourth embodiment of the present invention will be described.

Figure 7:
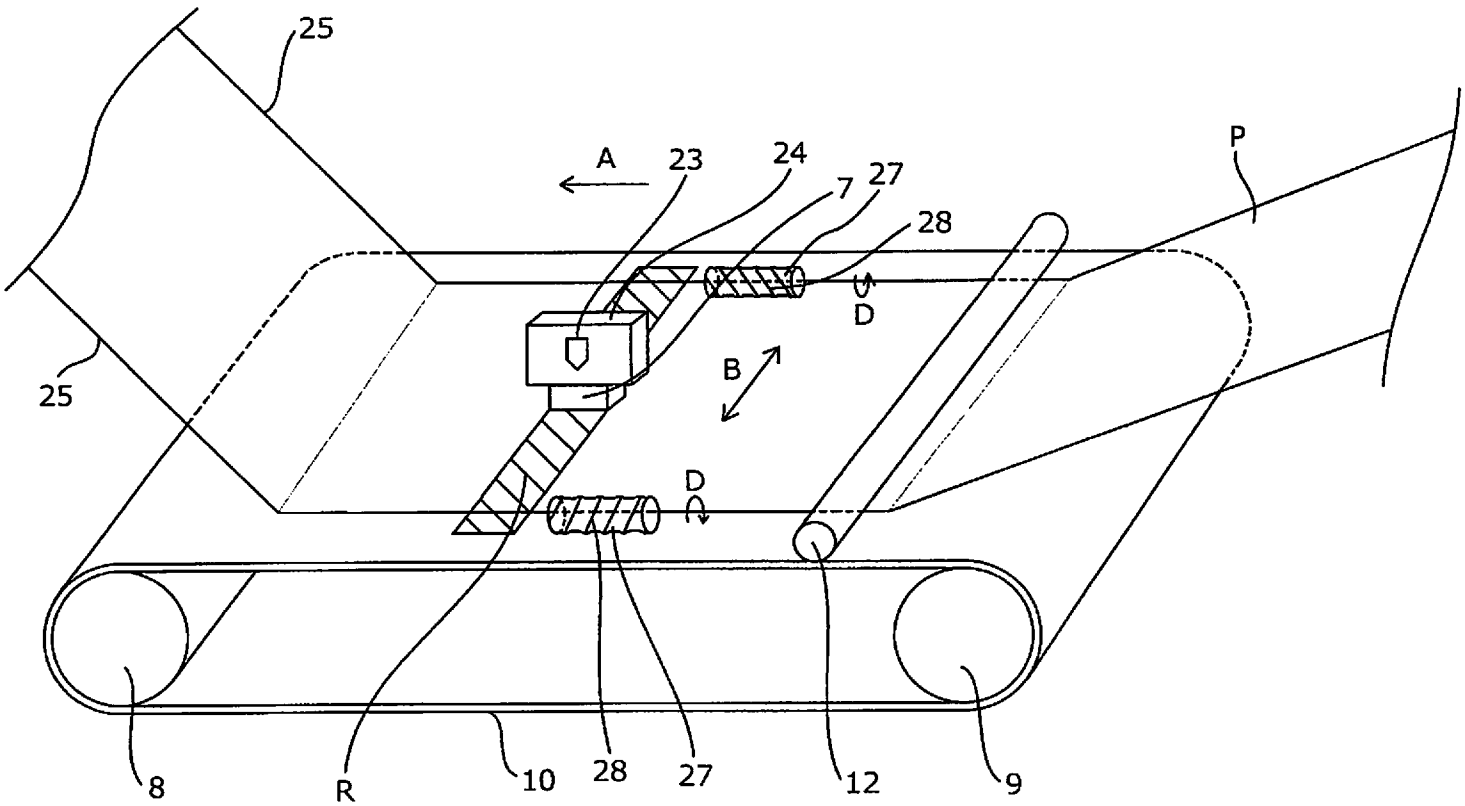
FIG. 7 is a schematic perspective diagram representing an adhesive belt of a recording apparatus of a fourth embodiment of the present invention.

FIG. 7 is a schematic perspective diagram of the recording apparatus 1 according to the fourth embodiment of the present invention. Here, the constituent members which are common to the fourth embodiment and the embodiments described above are illustrated with the same reference numerals, and detailed description of these constituent members will be omitted.

Only rotating bodies, which have spiral shapes where screw threads are configured as the contact sections of the guiding sections 19 with the end sections 25, being provided in the recording apparatus 1 of the present embodiment is different to the recording apparatus 1 of the third embodiment.

The recording apparatus 1 of the present embodiment is provided with guiding sections 27 with spiral shapes where screw threads 28 are configured and which fulfill a role as fluff attachment sections instead of the rotating brushes 26 in the recording apparatus 1 of the third embodiment. The fluff 22 is guided in the direction to the outside of the recording medium P by coming into contact with the screw threads 28 along with transporting of the recording medium P in the transport direction A, and the guided fluff 22 which is guided is attached to the adhesive belt 10 in this state.

Modified Example 1

In the recording apparatus 1 of the first and second embodiments described above, the guiding sections 19 may be inclined toward the downstream side in the transport direction from the inside of the adhesive belt to the outside and may become thicker along with the inclination to the downstream side. It is possible to induce and guide fluff and it is possible to reduce fluff build up.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A recording apparatus comprising:

an adhesive belt configured to support and transport a recording medium;

a recording head configured to record by discharging ink onto the recording medium that is supported by the adhesive belt; and a guiding section arranged an at upstream side relative to the recording head in a transport direction of the recording medium such that the guiding section faces the adhesive belt, the guiding section having an upstream end section disposed at an upstream-most end of the guiding section in the transport direction and configured to contact an end section of the recording medium, which is the end section in an intersecting direction that intersects with the transport direction, and guide fluff on the end section in a direction to an outside of the recording medium in the intersecting direction, the guiding section further having a first and second side end sections opposite each other in the intersecting direction and extending along the transport direction, the upstream end section being inclined relative to the transport direction and the intersecting direction from the first side end section to the second side end section.

2. The recording apparatus according to claim 1, further comprising a fluff attachment section configured to attach the fluff to the adhesive belt.

3. The recording apparatus according to claim 2, wherein the fluff attachment section is a rib configured to come into contact with the end section at a position which opposes the adhesive belt, and a shape of the rib is inclined toward a downstream side in the transport direction from an inside of the adhesive belt toward an outside.

4. The recording apparatus according to claim 1, wherein a constituent member of the guiding section is all arranged at the upstream side relative to the recording head in the transport direction.

5. The recording apparatus according to claim 1, wherein the guiding section is movable in directions which approach and move away from the adhesive belt, and the recording head is movable in directions which approach and move away from the adhesive belt by being linked with the guiding section.

6. The recording apparatus according to claim 1, wherein the guiding section is movable in the intersecting direction.

7. The recording apparatus according to claim 1, wherein the recording head is configured to record on the recording medium by scanning back and forth by being mounted onto a carriage which is movable back and forth in the intersecting direction, a sensor is provided in the carriage, and the sensor is configured to detect the end section of a region where recording is possible using the recording head in the intersecting direction of the recording medium by detecting the guiding section.

8. The recording apparatus according to claim 1, wherein the first side end section is disposed more outward relative to an axis of the adhesive belt, which extends in the transport direction through a center of a width of the adhesive belt in the intersecting direction, than the second side end section, and the upstream end section is gradually inclined outward from the second side section to the first side section as the upstream end section moves in the transport direction.

9. A recording apparatus comprising:

an adhesive belt configured to support and transport a recording medium;

a recording head configured to record by discharging ink onto the recording medium that is supported by the adhesive belt; and a guiding section arranged an at upstream side relative to the recording head in a transport direction of the recording medium and configured to guide fluff on an end section of the recording medium, which is the end section in an intersecting direction that intersects with the transport direction, in a direction to an outside of the recording medium in the intersecting direction, the guiding section being a rotating body which has an axis of a rotation extending in the transport direction and which is configured to come into contact with the end section at a position which opposes the adhesive belt such that a contact section of the rotating body with the end section moves from an inside of the adhesive belt toward an outside.

10. The recording apparatus according to claim 9, wherein the rotating body has a spiral shape where a screw thread is configured to come into contact with the end section.

* * * * *